US006496175B1

(12) United States Patent
Fukuo

(10) Patent No.: US 6,496,175 B1
(45) Date of Patent: Dec. 17, 2002

(54) OUTPUT CIRCUIT

(75) Inventor: Motoo Fukuo, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/541,596

(22) Filed: Apr. 3, 2000

(30) Foreign Application Priority Data

Apr. 5, 1999 (JP) ..... 11-097300

(51) Int. Cl.[7] ..... G09G 3/36

(52) U.S. Cl. ..... 345/99; 345/211; 345/212; 345/213

(58) Field of Search ..... 345/87, 94, 98, 345/99, 204, 211, 212, 213, 96

(56) References Cited

U.S. PATENT DOCUMENTS 4,899,113 A 2/1990 Buikema
5,283,477 A * 2/1994 Shibata ..... 327/306
5,455,534 A * 10/1995 Motegi et al. ..... 327/544
5,528,256 A * 6/1996 Erhart et al. ..... 345/96
6,028,598 A * 2/2000 Suyama et al. ..... 345/211
6,232,948 B1 * 5/2001 Tsuchi ..... 345/99

FOREIGN PATENT DOCUMENTS

| | | |
|---|---|---|
| JP | 7-221560 | 8/1995 |
| JP | 9-504389 | 4/1997 |
| KR | 87-1707 | 3/1987 |
| KR | 89-1217 | 3/1989 |

* cited by examiner

*Primary Examiner*—Kent Chang
*Assistant Examiner*—Tom V. Sheng
(74) *Attorney, Agent, or Firm*—Sughrue Mion, PLLC

(57) ABSTRACT

The output circuit is provided with an operational amplifier, a current supply circuit and an impedance changing circuit. The current supply circuit supplies current to the operational amplifiers at rising and falling of an output signal delivered by the operational amplifier. The impedance changing circuit changes the impedance between the operational amplifier and an output terminal.

15 Claims, 6 Drawing Sheets

OUTPUT CIRCUIT

BACKGROUND OF THE INVENTION

1. Field of the Invention

The present invention relates to an output circuit used in a dot inversion driving circuit or a line inversion driving circuit of a liquid crystal display apparatus or the like, and particularly to an output circuit of low power consumption and high slew rate.

2. Description of the Related Art

A liquid crystal display (LCD) apparatus is provided with driving circuits each of which applies a voltage to each pixel according to an image to be displayed. A dot inversion driving circuit of the prior art is disclosed in, for example, Japanese National Phase PCT Laid-Open Publication No. Hei 9-504389. FIG. 1 is a block diagram showing the constitution of the dot inversion driving circuit of the prior art.

The dot inversion driving circuit of the prior art is provided with a plurality of operational amplifiers 51. Two operational amplifiers 51 are shown in FIG. 1. A switching element 53 is connected to an output terminal of each of the operational amplifiers 51. The other end of the switching element 53 serves as an output terminal of the driving circuit. Every switching element 53 receives a control signal S51 input for the on/off control thereof. Connected to each output terminal is a panel load comprising a resistive element 54 and a capacitive element 55.

FIG. 2 is a timing chart showing the operation of the dot inversion driving circuit of the prior art. In the dot inversion driving circuit of the prior art made in the constitution described above, a voltage is output in high impedance state when the switching element 53 is off. When the switching element 53 is on, output voltage of the operational amplifier 51 is output directly.

An operational amplifier used in the dot inversion driving circuit or the like is also disclosed (Japanese Patent Laid-open Publication No. Hei 7-221560). In the operational amplifier of the prior art described in this publication, mean power consumption is reduced by decreasing the level of direct current bias voltage and increasing the current supply when charging the capacitive load, while increasing the level of direct current bias voltage after the charging is completed.

With the driving circuit of the prior art described in Japanese National Phase PCT Laid-Open Publication No. Hei 9-504389, however, there is a problem of high overall current consumption though the power consumption can be reduced by shorting a plurality of output terminals to obtain a voltage of an intermediate level thereof. This problem is caused by the current being supplied all times to the operational amplifier.

It may appear possible to reduce the overall current consumption by replacing only the operational amplifier with that described in Japanese Patent Laid-open Publication No. Hei 7-221560. However, it results in such a problem as undesirable oscillation or ringing of the output voltage or a decrease in the slew rate.

SUMMARY OF THE INVENTION

It is an object of the present invention to provide an output circuit capable of improving the slew rate and reducing the power consumption.

According to one aspect of the present invention, an output circuit comprises an operational amplifier, a current supply circuit and an impedance changing circuit. The current supply circuit supplies current to the operational amplifiers at rising and falling of an output signal from the operational amplifier. The impedance changing circuit changes the impedance between the operational amplifier and an output terminal.

According to the aspect of the present invention, the operational amplifier is supplied with a current from the current supply circuit at the rising and falling of the output from the operational amplifier. Thus it is made possible to decrease the level of current supply to the operational amplifier to a lower limit at times other than the rising and falling of the output signal. Slew rates at the times of rise and fall of the output signal are also improved by changing the impedance between the output terminals by means of the impedance changing circuit after the rise or fall has started, thereby reducing the load on the operational amplifier.

The impedance changing circuit may have two switching elements that have different values of resistance from each other and are connected in parallel with each other between the operational amplifier and the output terminal. Resistance of one of the switching elements that has higher resistance is preferably 80 to 100 times as large as that of the other switching element of lower resistance.

The impedance changing circuit may have a transfer gate switch connected between the operational amplifier and the output terminal. In this case, the impedance changing circuit may have a control element for controlling gate voltages of two field effect transistors that constitute the transfer gate switch.

Further, a capacitive load of the liquid crystal display apparatus may also be connected to the output terminal. In this case, the output circuit is used as, for example, a dot inversion driving circuit or a line inversion driving circuit.

Furthermore, the output circuit may also have at least another set of the operational amplifier, the bias circuit and the impedance changing circuit, with a shorting circuit that short-circuits the plurality of output terminals of each set. In case the output circuit is used as a dot inversion driving circuit, power consumption can be reduced further through short-circuiting of the output terminals thereby to obtain a voltage of an intermediate level thereof.

The nature, principle and utility of the invention will become more apparent from the following detailed description when read in conjunction with the accompanying drawings in which like parts are designated by like reference numerals or characters.

DETAILED DESCRIPTION OF THE PREFERRED EMBODIMENTS

Figure 1:
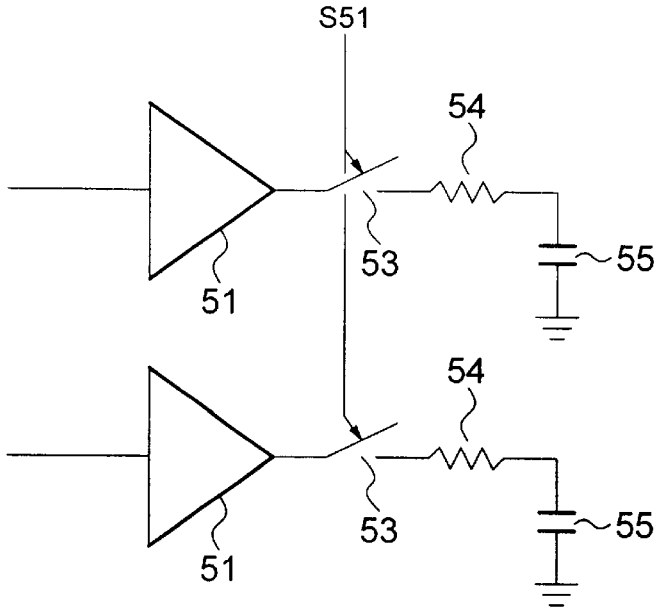
FIG. 1 (PRIOR ART)
FIG. 1 is a block diagram showing the constitution of a dot inversion driving circuit of a prior art.
Figure 2:
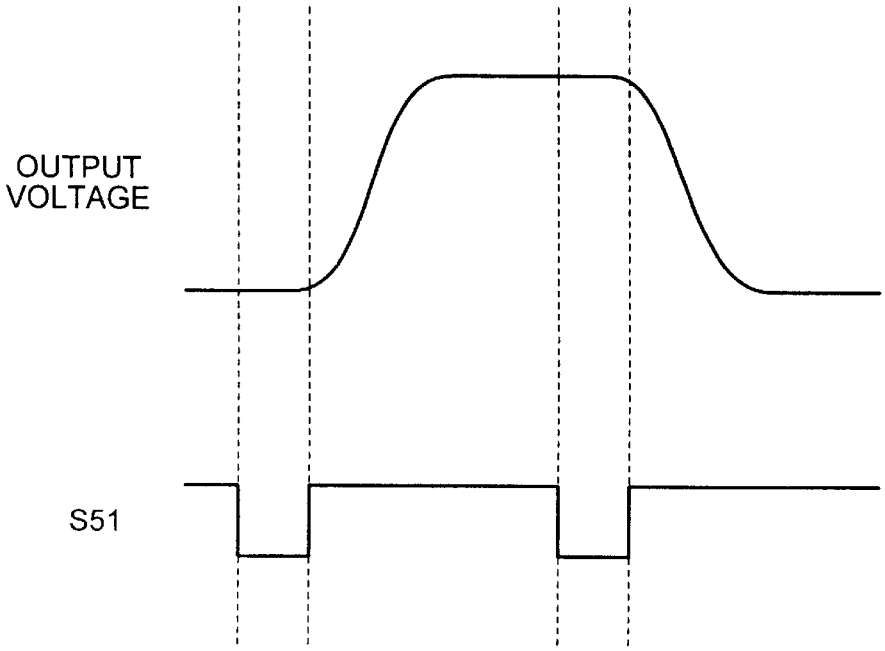
FIG. 2 (PRIOR ART)
FIG. 2 is a timing chart showing the operation of the dot inversion driving circuit of the prior art.
Figure 3:
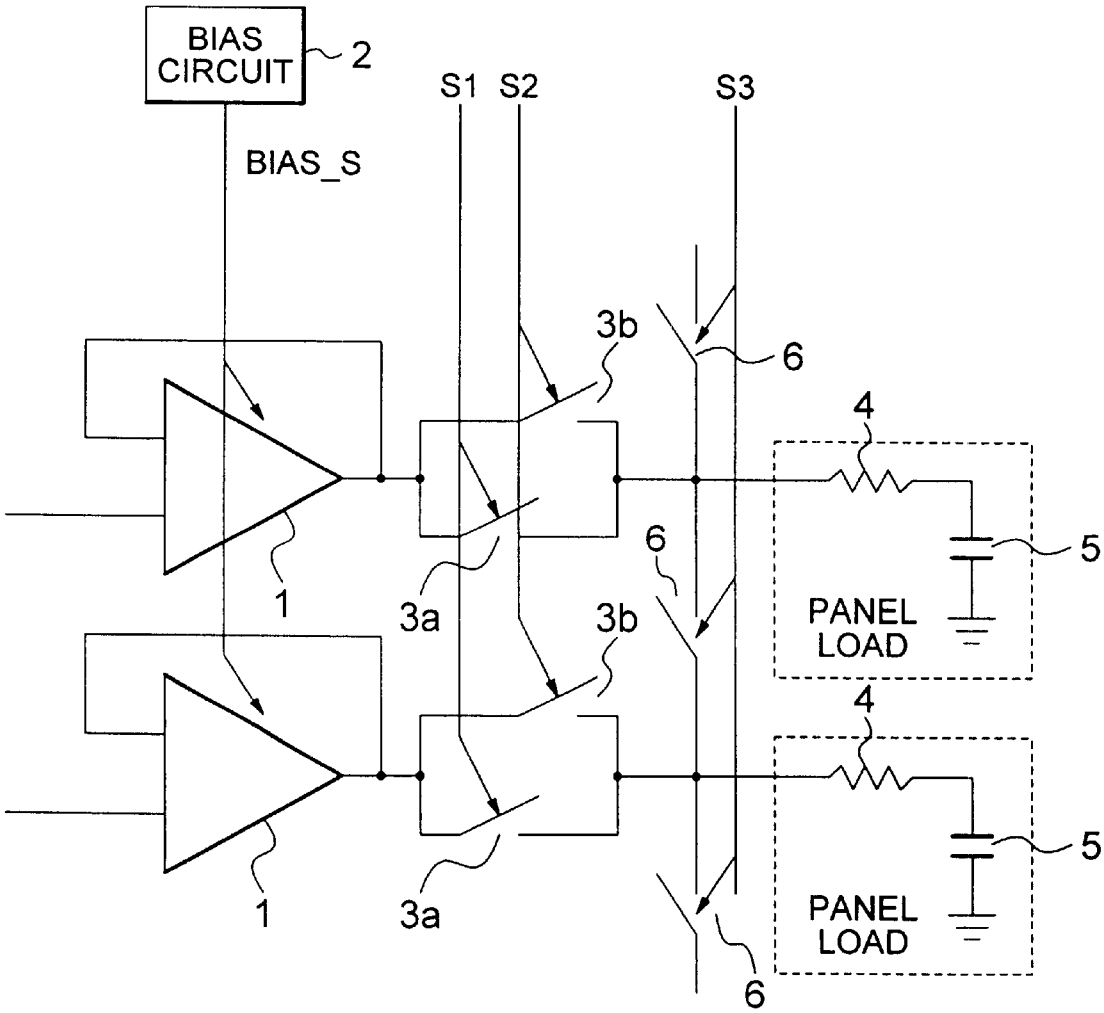
FIG. 3 is a block diagram showing the constitution of an output circuit according to a first embodiment of the present invention.

The output circuit according to preferred embodiments of the present invention will now be described in detail below with reference to the accompanying drawings. FIG. 3 is a block diagram showing the constitution of the output circuit according to the first embodiment of the invention. The output circuit of the first embodiment is used as a dot inversion driving circuit for a liquid crystal display apparatus.

The first embodiment comprises a plurality of operational amplifiers 1. The operational amplifiers 1 have a bias circuit 2 in common which supplies a slew rate control (SRC) signal BIAS_S. The operational amplifiers 1 change the amplification factors thereof in conjunction with the slew rate control signal BIAS_S.

Each of the operational amplifiers 1 is also provided with two switching elements 3*a,* 3*b* connected in parallel with each other to the output terminal thereof. The switching elements 3*a*, 3*b* may be constituted from, for example, field effect transistors and have on-resistance. The switching elements 3*a*, 3*b* have resistance of different values. For example, the switching element 3*a* has resistance in a range from about 20 k to 30 kΩ, while the switching element 3*b* has resistance in a range from about 200 to 300Ω. The switching element 3*a* receives the input of a control signal S1 which controls the on/off status thereof, while the switching element 3*b* receives the input of a control signal S2 which controls the on/off status thereof.

Further connected to the other ends of the switching elements 3*a*, 3*b,* that are connected to the output terminal of the operational amplifier 1, are a resistive element 4 and a capacitive element 5 being connected in series in this order. The resistive element 4 and the capacitive element 5 may constitute a panel load of the liquid crystal display apparatus. Connected to a junction (output terminal), where the switching elements 3*a*, 3*b* and the resistive element 4 are connected, is a switching element 6. The switching element 6 is, for example, a transfer gate switch. The switching element 6 receives the input of a standby (STB) signal S3 which controls the on/off status thereof. The switching elements 6 are connected to each other in series, with one electrode of a capacitive element (not shown), of which the other electrode is grounded, being connected to one end thereof.

Since the output circuit is used for inverting a dot, output terminals thereof connected to adjacent panel loads provide outputs that are in inverted states from each other.

In the first embodiment, a control circuit (not shown) is provided to control the control signals S1, S2 and S3.

Figure 4:
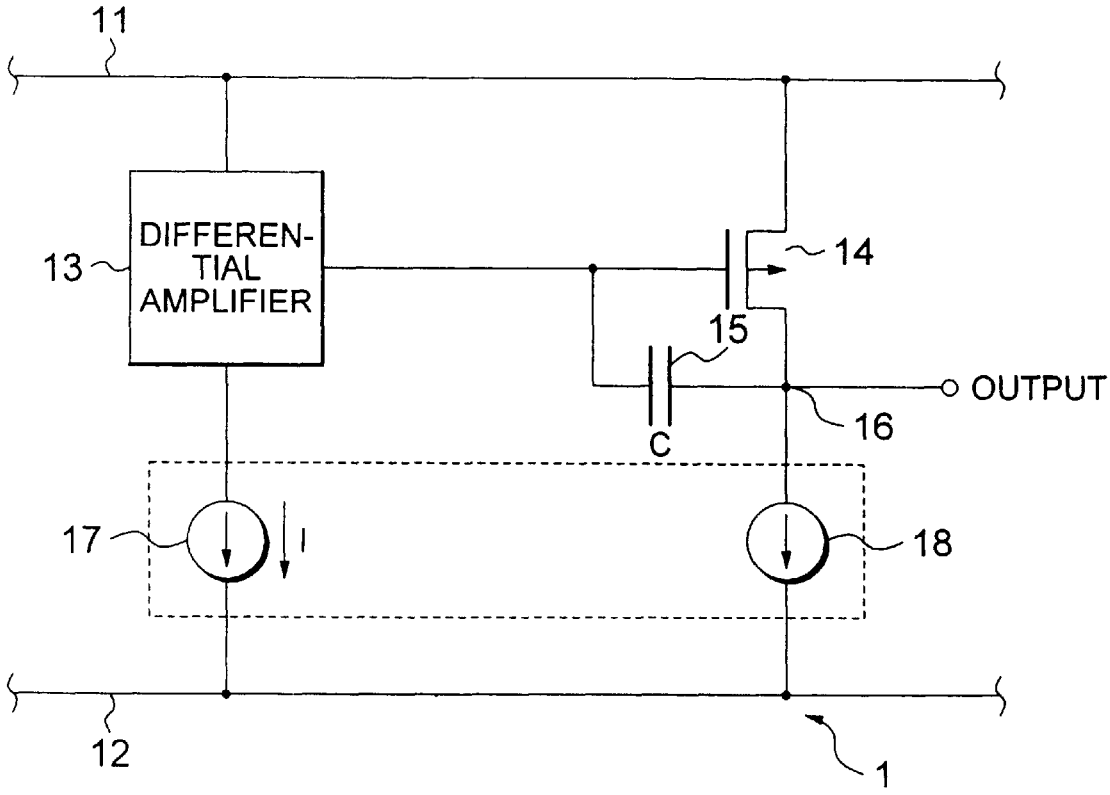
FIG. 4 is a circuit diagram showing the constitution of an operational amplifier 1.
Figure 5:
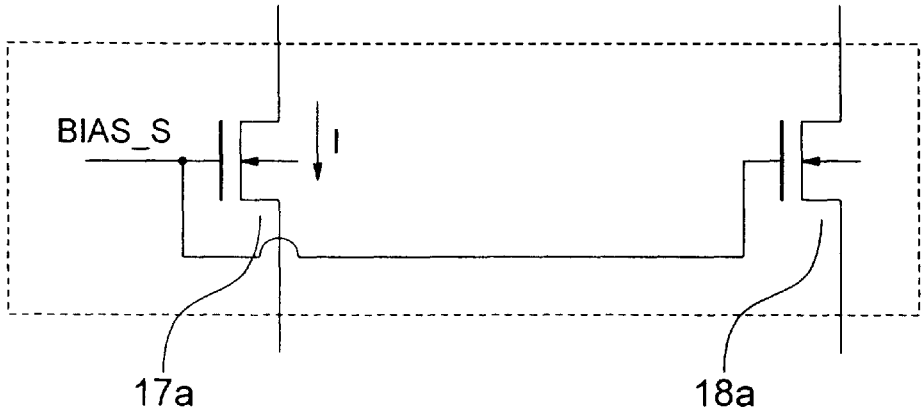
FIG. 5 is a circuit diagram showing an example of current sources 17, 18.

FIG. 4 is a circuit diagram showing the configuration of the operational amplifier 1. The operational amplifier 1 has a differential amplifier 13 connected between two signal lines 11 and 12. Connected to an output terminal of the differential amplifier 13 are a gate electrode of an N-channel MOS transistor 14 and one end of a capacitive element 15. A source electrode of the transistor 14 is connected to the signal line 11 and a drain electrode thereof is connected to the other end of the capacitive element 15. The output signal of the operational amplifier 1 is provided at a junction 16 of the source electrode of the transistor 14 and the other end of the capacitive element 15. Also connected between the differential amplifier 13 and the signal line 12, and between the junction 16 and the signal line 12 are current source 17, 18, respectively. FIG. 5 is a circuit diagram showing an example of the current sources 17, 18.

As the current source 17, for example, an N-channel MOS transistor 17*a* that receives the input of SRC signal BIAS_S at the gate electrode thereof may be connected between the differential amplifier 13 and the signal line 12. As the current source 18, an N-channel MOS transistor 18*a* that receives the input of SRC signal BIAS_S at the gate electrode thereof may be connected between the junction 16 and the signal line 12.

In the operational amplifier 1 having the configuration described above, slew rate is proportional to the value of C/I where C represents the capacitance of the capacitive element 15 and I represents the current flowing in the current source 17.

Figure 6:
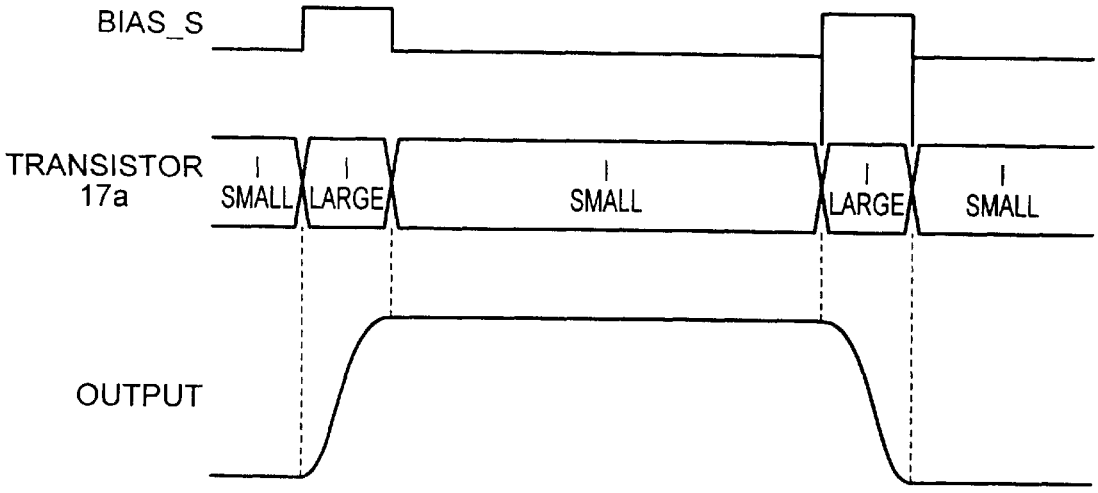
FIG. 6 is a timing chart showing the operation of the operational amplifier 1.

Now the operation of the operational amplifier 1 will be described below. FIG. 6 is a timing chart showing the operation of the operational amplifier 1.

Current level flowing in the transistor 17*a* is low and the output signal level thereof is also low before the SRC signal BIAS_S turns on. When the output rises from this state, the bias is turned on thereby to increase the current flowing in the transistor 17*a*. This increases the rising rate.

When the output increases and stabilized, the SRC signal BIAS_S is turned off to decrease the current flowing in the transistor 17*a*.

Then the SRC signal BIAS S is turned on again thereby to increase the current flowing in the transistor 17*a*.

When the output decreases and stabilized, the SRC signal BIAS_S is turned off again thereby to decrease the current flowing in the transistor 17*a*.

Figure 7:
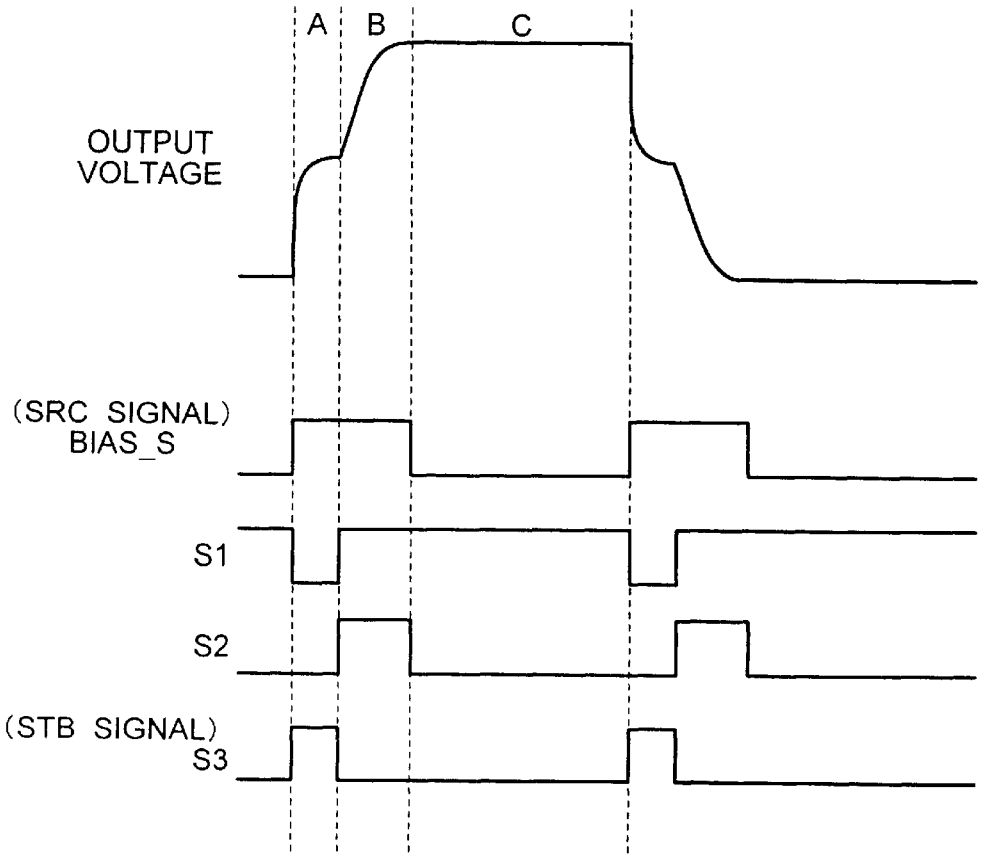
FIG. 7 is a timing chart showing the operation of the output circuit according to the first embodiment of the present invention.

Now the operation of the output circuit of the first embodiment having the configuration described above will be described below. FIG. 7 is a timing chart showing the operation of the output circuit according to the first embodiment of the present invention. Table 1 given below shows the on/off states of the control signal in different periods.

TABLE 1

| Period | BIAS_S | S1 | S2 | S3 |
|---|---|---|---|---|
| A | On | Off | Off | On |
| B | On | On | On | Off |
| C | Off | On | Off | Off |

First, in a load resetting period (period A), the SRC signal BIAS_S is turned on, the control signals S1 and S2 are turned off, and the STB signal S3 is turned on. This causes all the output terminals to be shorted and the electric charge that has been charged on the panel load is reset. Since the outputs from adjacent output terminals are in mutually inverted states as mentioned earlier, the electric charges are transferred between the output terminals with the potential thereof reaching an intermediate level. In the operational amplifier 1, since the SRC signal BIAS_S is in the first on state, the amplification factor is high and the slew rate is also high.

Then in a high-speed writing period (period B), the control signals S1 and S2 are turned on and the STB signal S3 is turned off while maintaining the SRC signal BIAS_S in on state. Since the STB signal S3 is turned off, the output terminals are released from the shorted state. Also as the control signals S1 and S2 are turned on, load of the operational amplifier 1 decreases. Further, since the SRC signal BIAS_S remains on, the output voltage changes at a fast rate.

Then, with the control signals S1 and S3 being kept in on and off states, respectively, the SRC signal BIAS_S is turned off and the control signal S2 is turned off. Since the SRC signal BIAS_S is turned off, amplification factor of the operational amplifier 1 decreases to the lowest level. At the same time, since the control signal S2 for the low-resistance switching element 3*b* is turned off, load increases to restrain the output voltage from oscillating.

According to this embodiment, as described above, since the impedance between the operational amplifier 1 and the output terminal can be changed in two steps by means of the switching elements 3*a*, 3*b*, a desired output voltage can be achieved at a high speed. This means a high slew rate. Also because the output terminals can be mutually shorted at the same time the output voltage of the output circuit working as the dot inversion driving circuit begins to rise, power consumption can be reduced by utilizing the intermediate voltage.

In case the impedance between the operational amplifier 1 and the output terminal cannot be changed, such a problem occurs as described below. When the switching element 3*a* is not provided, for example, the output voltage oscillates when increasing because there is only the switching element 3*b* which has resistance of about 200 to 300Ω. When the switching element 3*b* is not provided, on the other hand, rising rate of the output voltage decreases resulting in a lower slew rate because there is only the switching element 3*a* which has resistance of about 20 k to 30 kΩ.

Values of resistance of the switching elements 3*a*, 3*b* are not limited to those described above, and can be set according to the gain of the operational amplifier 1. In order to prevent oscillation and maintain a high slew rate, however, it is desirable that resistance of one of the switching elements is at least about 80 times that of the other. When consideration is given to practical use, this factor is preferably from about 80 to 100.

Figure 8:
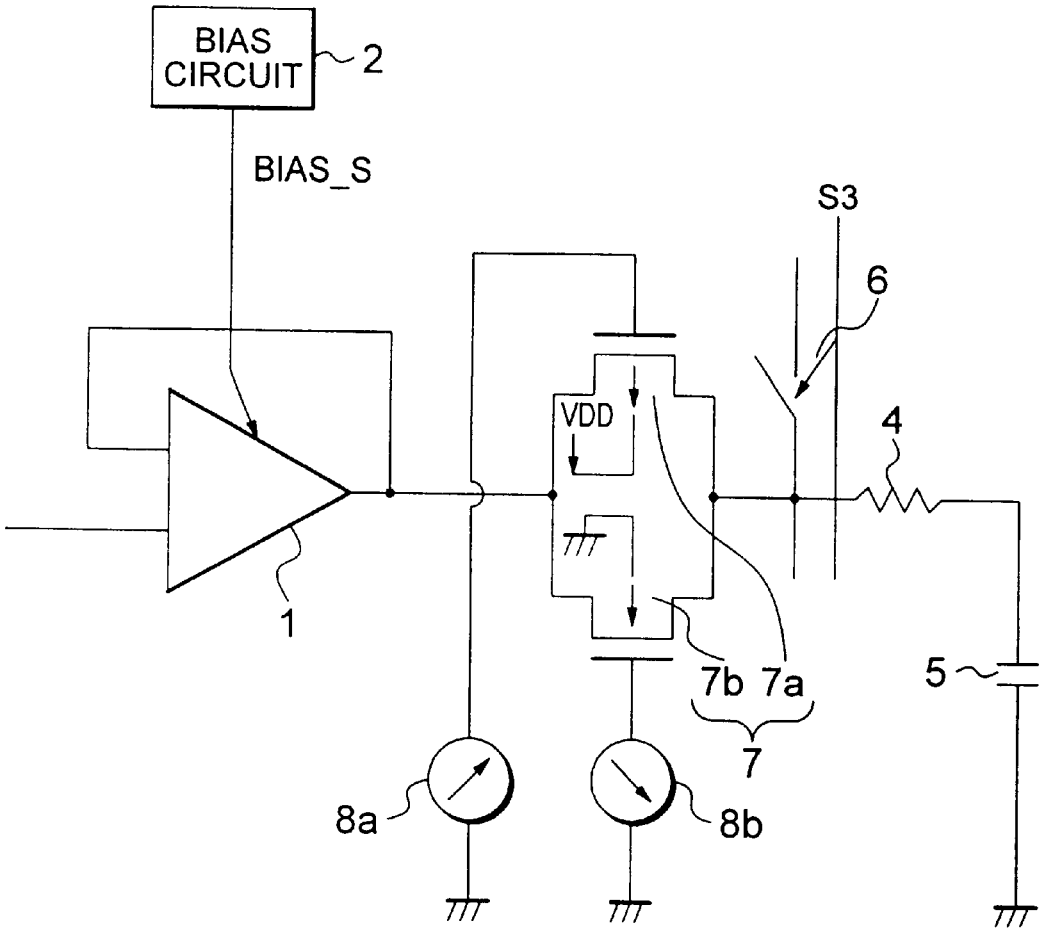
FIG. 8 is a block diagram showing the constitution of an output circuit according to a second embodiment of the present invention.

While the two switching elements 3*a*, 3*b* are provided in the first embodiment, for example, a single switching element may be provided as long as the impedance can be changed in at least two steps thereof. Second embodiment will now be described below where the impedance is changed with a single switching element. FIG. 8 is a block diagram showing the constitution of an output circuit according to the second embodiment. In the second embodiment shown in FIG. 8, components identical with those of the first embodiment shown in FIG. 3 will be denoted with the same reference numerals and detailed description thereof will be omitted. For components that are provided in plurality in succession such as the operational amplifiers 1, only one piece thereof is shown.

In the second embodiment, a transfer gate switch 7 consisting of a P-channel MOS transistor 7*a* and an N-channel MOS transistor 7*b* is connected between the operational amplifier 1 and the resistive element 4. A resistance regulating power source (control element) 8*a* or 8*b* is connected to the gate of the transistor 7*a* or 7*b*, respectively. A voltage from the resistance regulating power source 8*a* or 8*b* is supplied to the gate of the transistor 7*a* or 7*b*, respectively, with the gate voltage being regulated by the resistance regulating power source 8*a* or 8*b*.

Figure 9A:
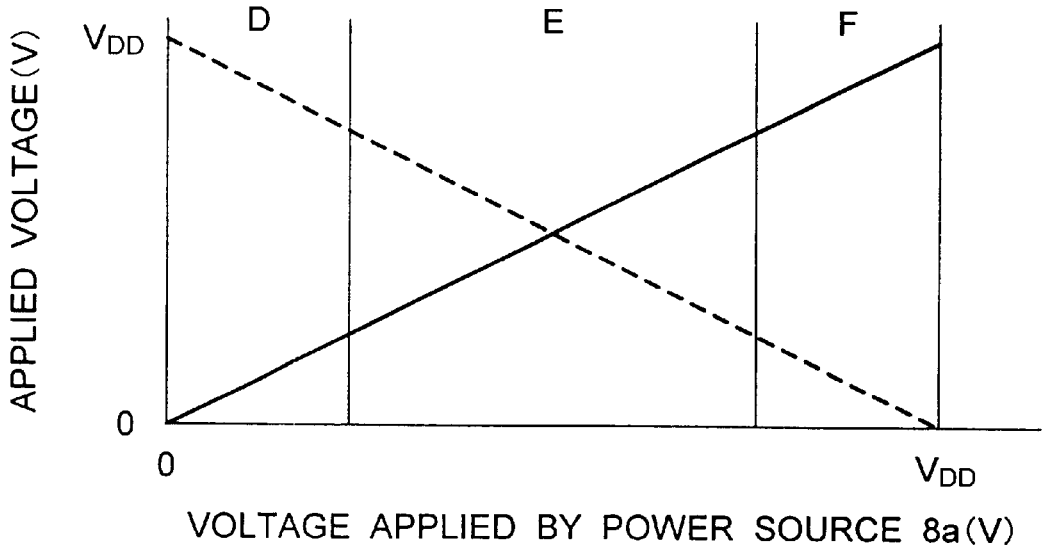
FIG. 9A is a graph showing the relationship between gate voltages of the transistors 7*a,* 7*b* and a voltage applied by the resistance regulating power sources 8*a,* and FIG. 9B is a graph showing the relationship between the voltage applied by the resistance regulating power source 8*a* and resistance of a transfer gate switch 7.
Figure 9B:
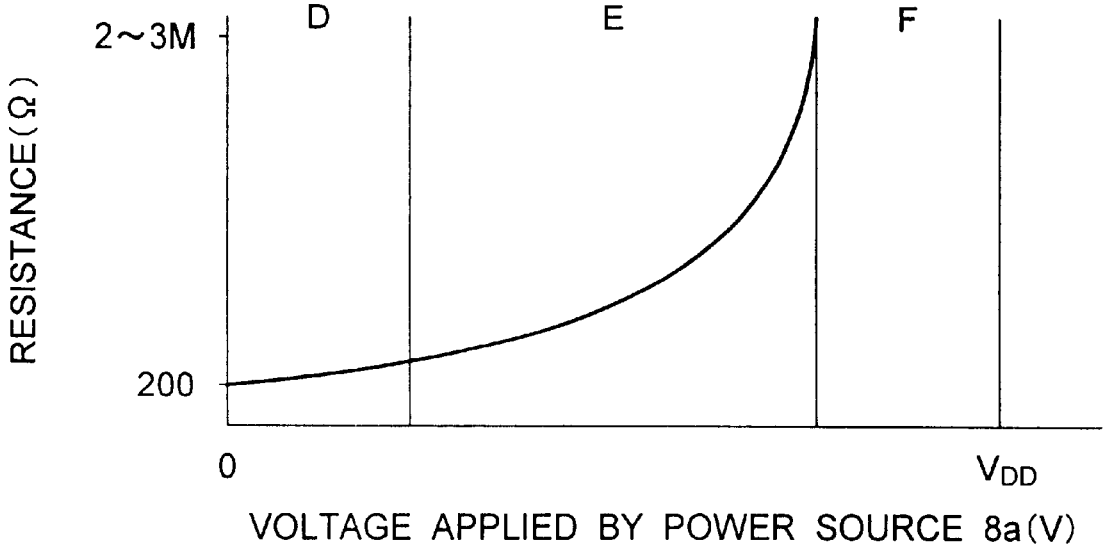

FIG. 9A is a graph showing the relationship between gate voltages of the transistors 7*a*, 7*b* and a voltage applied by the resistance regulating power sources 8*a*. FIG. 9B is a graph showing the relationship between the voltage applied by the resistance regulating power source 8*a* and resistance of the transfer gate switch 7. In FIG. 9A, a solid line represents the gate voltage of transistor 7*a* (a voltage applied by the resistance regulating power source 8*a*), a dashed line represents the gate voltage of transistor 7*b* (a voltage applied by the resistance regulating power source 8*b*).

As shown in FIG. 9A, sum of the voltage applied by the resistance regulating power source 8*a* and the voltage applied by the resistance regulating power source 8*b* is always $V_{DD}$. Consequently, as the voltage applied by the resistance regulating power source 8*a* increases, the voltage applied by the resistance regulating power source 8*b* decreases by the amount of increase in the former. Then as the voltage applied by the resistance regulating power source 8*a* increases and the voltage applied by the resistance regulating power source 8*b* decreases accordingly as shown in FIG. 9B, on-resistance of the transfer gate switch 7 increases.

Therefore, shown in FIG. 9B, region D, where a low voltage is applied by the resistance regulating power source 8*a*, and region E, where a high voltage is applied by the resistance regulating power source 8*a*, for example, can be used for the two steps of impedance. In region F shown in FIG. 9B, transistors 7*a* and 7*b* are both off. This state may be used in the period A shown in FIG. 7.

Alternatively, one MOS transistor may be used as an element for changing the impedance. In this case, too, the on-resistance can be changed in at least two steps by controlling the gate voltage.

While the first and second embodiments are the output circuits used as the dot inversion driving circuits, they may also be used as line inversion driving circuits. In this case, the switching element 6 is not needed since outputs of adjacent output terminals are not inverted.

Further, while these output circuits are all used as driving circuits for the liquid crystal display apparatus, they may also be used as output circuits for other apparatuses. In this case, instead of the panel load, various circuits are connected to the output terminal according to the application.

According to the present invention, since there are provided the current supply circuit which supplies current to the operational amplifier at the rise and fall of the output and the impedance changing circuit to change the impedance between the operational amplifier and the output terminal thereof, it is not necessary to supply current to the operational amplifier except for the time when the output is rising or falling. Thus the power consumption is reduced. Also the slew rate can be improved by decreasing the load of the operational amplifier when the output is rising or falling. As a result, when the output circuit is used as the driving circuit for the liquid crystal display apparatus, not only the power consumption of the liquid crystal display panel can be reduced and the panel life can be elongated, but also yield can be improved by increasing the rate of rise and fall even when the load increases due to some defects of the panel.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. An output circuit comprising:

an operational amplifier;

a current supply circuit which supplies current to said operational amplifier at rising and falling of an output signal from said operational amplifier; and an impedance changing circuit which changes impedance between said operational amplifier and an output terminal.

2. The output circuit according to claim 1, wherein said impedance changing circuit has two switching elements having different values of resistance from each other, respectively, said switching elements being connected in parallel with each other between said operational amplifier and said output terminal.

3. The output circuit according to claim 2, wherein, resistance of one of said two switching elements having higher resistance is 80 to 100 times as large as that of the other switching element of lower resistance.

4. The output circuit according to claim 3, wherein a capacitive load of a liquid crystal display apparatus is connected to said output terminal.

5. The output circuit according to claim 4 further comprising:

at least one set of second operational amplifier, a bias circuit, a second impedance changing circuit, said second operational amplifier, said bias circuit and said second impedance changing circuit having similar constitutions as those of said operational amplifier, said bias circuit and said impedance changing circuit, respectively; and a shorting circuit which short-circuits the output terminals of each set.

6. The output circuit according to claim 2, wherein a capacitive load of a liquid crystal display apparatus is connected to said output terminal.

7. The output circuit according to claim 6 further comprising:

at least one set of second operational amplifier, a bias circuit, a second impedance changing circuit, said second operational amplifier, said bias circuit and said second impedance changing circuit having similar constitutions as those of said operational amplifier, said bias circuit and said impedance changing circuit, respectively; and a shorting circuit which short-circuits the output terminals of each set.

8. The output circuit according to claim 1, wherein said impedance changing circuit has a transfer gate switch connected between said operational amplifier and said output terminal.

9. The output circuit according to claim 8, wherein said impedance changing circuit has a control element which controls gate voltages of two field effect transistors constituting said transfer gate switch.

10. The output circuit according to claim 9, wherein a capacitive load of a liquid crystal display apparatus is connected to said output terminal.

11. The output circuit according to claim 10 further comprising:

at least one set of second operational amplifier, a bias circuit, a second impedance changing circuit, said second operational amplifier, said bias circuit and said second impedance changing circuit having similar constitutions as those of said operational amplifier, said bias circuit and said impedance changing circuit, respectively; and a shorting circuit which short-circuits the output terminals of each set.

12. The output circuit according to claim 8, wherein a capacitive load of a liquid crystal display apparatus is connected to said output terminal.

13. The output circuit according to claim 12 further comprising:

at least one set of second operational amplifier, a bias circuit, a second impedance changing circuit, said second operational amplifier, said bias circuit and said second impedance changing circuit having similar constitutions as those of said operational amplifier, said bias circuit and said impedance changing circuit, respectively; and a shorting circuit which short-circuits the output terminals of each set.

14. The output circuit according to claim 1, wherein a capacitive load of a liquid crystal display apparatus is connected to said output terminal.

15. The output circuit according to claim 14 further comprising:

at least one set of second operational amplifier, a bias circuit, a second impedance changing circuit, said second operational amplifier, said bias circuit and said second impedance changing circuit having similar constitutions as those of said operational amplifier, said bias circuit and said impedance changing circuit, respectively; and a shorting circuit which short-circuits the output terminals of each set.

* * * * *